United States Patent [19]

Kupper

[11] 4,162,012

[45] Jul. 24, 1979

[54] DEVICE FOR ASSORTING INADEQUATELY WOUND COILS

[75] Inventor: Wilhelm Küpper, Wegberg, Fed. Rep. of Germany

[73] Assignee: W. Schlafhorst & Co., Mönchen-Gladbach, Fed. Rep. of Germany

[21] Appl. No.: 858,385

[22] Filed: Dec. 7, 1977

[30] Foreign Application Priority Data

Dec. 8, 1976 [DE] Fed. Rep. of Germany ..... 2655561

[51] Int. Cl.[2] ..... B07C 5/12

[52] U.S. Cl. ..... 209/662; 209/927

[58] Field of Search ..... 209/99, 100, 101, 97, 209/103, 107, 102, 662, 927

[56] References Cited

U.S. PATENT DOCUMENTS

| | | | |
|---|---|---|---|
| 2,343,042 | 2/1944 | Barry | 209/107 |
| 3,661,257 | 5/1972 | Hall et al. | 209/101 |

*Primary Examiner*—Allen N. Knowles

*Attorney, Agent, or Firm*—Herbert L. Lerner

[57] ABSTRACT

Device for separating-out inadequately wound coils from coils conveyed individually and serially by an horizontal or inclined conveyor in direction of the longitudinal axis of the coils including means defining at least one coil support surface for the coils disposed at a section of the conveyor, the support surface being formed with at least one sorting opening widening in conveyance direction of the conveyor.

4 Claims, 4 Drawing Figures

Figures 1, 2, 3, 4:
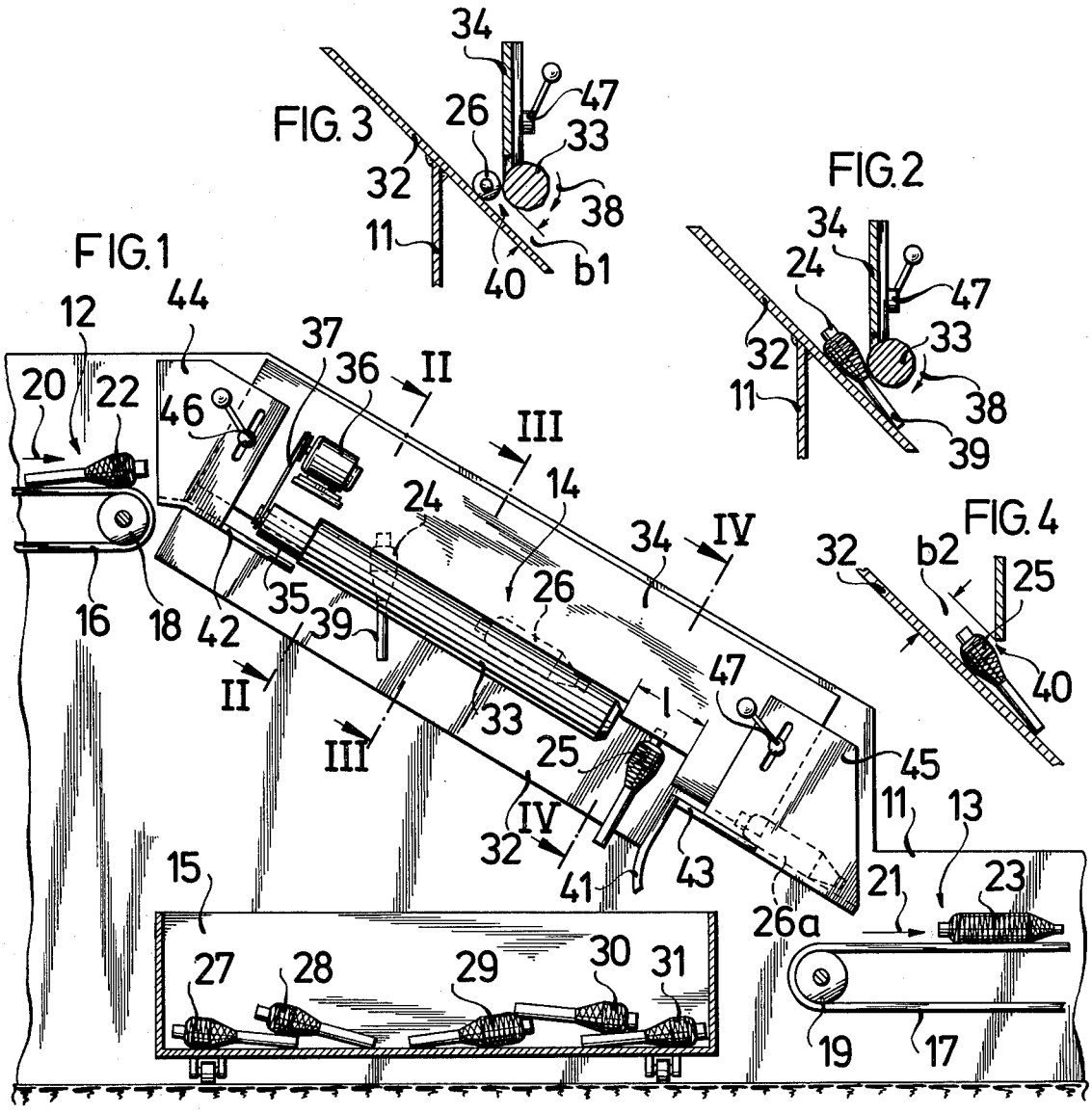

12
20
22
44
46
37
36
II
III
14
24
34
IV
26
35
39
42
16
18
33
25
47
l
45
11
13
32
41
43
15
27
28
29
30
31
21
23
26a
19
17
34
47
26
33
32
38
11
40
b1
24
39
b2
25
40

DEVICE FOR ASSORTING INADEQUATELY WOUND COILS

The invention relates to a device for assorting or separating-out inadequately wound coils from coils which are individually transported sequentially by means of a horizontal or inclined conveyor and, more specifically for separating-out inadequately wound spinning coils or cops.

Disturbances occur in winding machines when inadequately wound coils are delivered as supply coils or cops into the machine.

It is an object of the invention to provide a device for separating inadequately wound coils or spinning cops from adequately wound coils or cops that are suitable as supply coils, in order to avoid the foregoing disturbances.

With the foregoing and other objects in view, there is provided, in accordance with the invention, a device for separating-out inadequately wound coils from coils conveyed individually and serially by an horizontal or inclined conveyor in direction of the longitudinal axis of the coils comprising means defining at least one coil support surface for the coils disposed at a section of the conveyor, the support surface being formed with at least one sorting opening widening in conveyance direction of the conveyor.

In accordance with another feature of the invention, the sorting opening has a starting width greater than the diameter of the coil cores but smaller than the diameter of an adequately wound coil, the sorting opening in the conveyance direction widening, preferably without any transition, to an opening section having a width greater than that of the coil diameter, the widened opening section of the sorting opening having a length shorter than the length of an adequately wound coil.

The length of the widened opening section of the sorting aperture or opening is shorter than the length of an adequately wound coil core. If an inadequately wound coil core is transported or shifted in direction of the longitudinal axis thereof over such a sorting opening or aperture, the unwound part of the coil core falls through the narrower part of the sorting aperture initially. The coil or cop accordingly assumes a position inclined to the conveyance or transport direction. Upon being further shifted or transported, the coil is delivered into the widened opening section of the sorting opening or aperture and drops downwardly. An adequately wound coil core has neither the possibility of assuming a position that is inclined toward the direction of conveyance or transport nor the possibility of dropping downwardly through the widened section of the sorting opening or aperture.

It is advantageous also to utilize the force of gravity for transporting or conveying the coils. Therefore, in accordance with a further feature of the invention, the section of the conveyor has a downward inclination or declines in direction of conveyance and the device of the invention also includes a coil collecting device disposed beneath the sorting opening or openings.

In accordance with an added feature of the invention, means defining two coil support surfaces are provided at the conveyor section and are inclined relative to one another in a V-shaped manner.

In accordance with an additional feature of the invention, at least part of the coil support surface in vicinity of the sorting opening is movable in the conveyance direction and/or a direction transverse thereto. Movement in the conveyance direction may be effected, for example, by an endless conveyor belt. Movement transversely to the conveyance direction is advantageously achieved, in accordance with yet another feature of the invention by providing at least part of the coil support surface on a rotating cylinder.

In accordance with yet a further feature of the invention, the rotary cylinder is formed with a multifaceted surface, and is rotatable in a direction tending to oppose passage of the inadequately wound coils through the sorting opening or openings thereby preventing jamming of the coils.

The irregularities or uneven portions of the cylinder surface ensure that the conveyed coils are raised by being jarred repeatedly, and conveyed or transported in conveyance direction.

At the points of contact of the cylinder with the coil, the direction of rotation of the cylinder is opposite to the direction of the force of gravity.

So that the device can be adjusted or set for varying coil dimensions, in accordance with yet an added feature of the invention, means are provided for adjusting the width of the sorting opening or openings.

In accordance with a concomitant feature of the invention, means defining two coil support surfaces at the section of the conveyor are provided, the two coil support surfaces being inclined in a V-shaped manner relative to one another, at least one of the two coil support surfaces being adjustable in position relative to the other of the coil support surfaces.

Advantages attained with the invention of this application are especially that coils or cops which are conveyed individually and serially or sequentially are scanned during the conveyance or transport thereof for adequate winding, and inadequately wound coils are simultaneously sorted or separated out.

Other features which are considered as characteristic for the invention are set forth in the appended claims.

Although the invention is illustrated and described herein as embodied in a device for assorting inadequately wound coils, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing in which:

FIG. 1 is a diagrammatic side elevational view, partly in section, of a device for separating-out inadequately wound coils, according to the invention; and FIGS. 2, 3 and 4 are cross-sectional views of FIG. 1, taken along the respective lines II—II, III—III and IV—IV in direction of the arrows.

Referring now to the drawing and first, particularly, to FIG. 1 thereof, there is shown a rear wall 11, to which a conveyor system 12, 13, 14 is fastened. The conveyor system is in three parts, one part shown at the upper left-hand side of FIG. 1 constructed as a horizontal conveyor 12, and one part at the lower right-hand side of FIG. 1 is a horizontal conveyor 13. A section 14 of the conveyor system is constructed as an inclined chute-like conveyor. Underneath the inclined conveyor section 14, a collecting device 15 is provided which is formed of a box equipped with an undercarriage.

The horizontal conveyor 12 has an endless conveyor belt 16 and a belt roller 18, and the horizontal conveyor 13 has an endless conveyor belt 17 and a belt roller 19. The conveyor belt 16 is moved in direction of the arrow 20, and the conveyor belt 17 in direction of the arrow 21. On the conveyor belt 16, an inadequately wound spinning coil or cop 22 is being conveyed, and on the conveyor belt 17, an adequately wound spinning coil or cop 23 is being conveyed. Previously sorted or separated, inadequately wound coils 27 to 31 are lying in the collecting device 15.

As apparent more readily from FIGS. 2 and 3, the conveyor section 14 has two coil support surfaces, a rear coil support surface 32, which is fastened at an inclination to the rear wall 11, and a front coil support surface formed, in part, of a rotating cylinder 33 and, in part, of a front wall 34. Both coil support surfaces are inclined relative to one another in a V-shaped manner. The cylinder 33 is rotatably mounted in a bearing 35 fastened to the front wall 34, and is driven by means of a serrated belt 37 which is revolved by a motor 35 that is fastened to the front wall 34. The cylinder 33 rotates in direction of the arrow 38. The surface of the cylinder 33 is multifaceted i.e. is formed with a multiplicity of longitudinally extending planar surfaces. The cylinder 33 is disposed in a cutout formed in the front wall 34 in a manner that a sorting aperture having a width b1 (FIG. 3) is provided between the coil support surface 32 and the surface of the cylinder 33. At the lower end of the cylinder 33, this sorting aperture is broadened to an aperture of length 1 (FIG. 1) and width b2 (FIG. 4). The width b1 is of such dimension that, while the coil core 39 of an inadequately wound spinning coil or cop, for example, the coil 24, can hang downwardly therethrough (FIG. 2), in accordance with the force of gravity, the rest of the coil 24 cannot. An adequately wound coil, for example, the coil 26, on the other hand, is transported farther on in a manner that the longitudinal axis thereof is extended in the transport direction. After leaving the cylinder 33, the coil 26 has no opportunity to flip into another position fast enough. It is therefore transported farther on in transport direction and, in the further course of being transported, reaches the position 26*a* for example. An inadequately wound coil, on the other hand, has, beforehand, assumed a position which is at an angle to the transport direction, before it leaves the cylinder 33, and it subsequently slides out of the expanded part of the sorting aperture 40, a baffle 41 (FIG. 1) serving as a guide therefor. In FIGS. 1 and 4, the coil core 25, for example, is just about to slide downwardly out of the expanded part of the sorting aperture 40.

In FIG. 1, there are shown a base plate 42 located above the sorting aperture, and a further base plate 43, located below the sorting aperture. These base plates 42 and 43 serve as inlet and outlet guides, respectively, for the coils. The base plate 42 supports a vertical wall 44, and the base plate 43, also supports a similar vertical wall 45. The front wall 34 is adjustably fastened to these two walls 44 and 45 by suitable butterfly or wing bolts 46 and 47, respectively.

As mentioned hereinbefore, the invention of the instant application is not limited to the embodiment illustrated and described. The displaceability or mobility of the coil support surface or of a part thereof can be ensured, for example, by suitably disposing conveyor belts, vibrators, shakers or jolters or the like. Entrainment of the coils can be effected in the vicinity of the sorting apertures by special entrainer members or dogs. The separation or sorting of the inadequately wound coils can then also occur during transport of the coils in a horizontal plane.

There are claimed:

1. Device for separating-out inadequately wound coils from coils conveyed individually and serially by at least one of an horizontal and inclined conveyor in direction of the longitudinal axis of the coils comprising means defining at least one coil support surface for the coils disposed at a section of the conveyor, said support surface being formed with at least one sorting opening widening in conveyance direction of the conveyor, said sorting opening having a starting width greater than the diameter of the coil cores but smaller than the diameter of an adequately wound coil, said sorting opening in said conveyance direction widening to an opening section having a width greater than that of the coil diameter, said widened opening section of said sorting opening having a length shorter than the length of an adequately wound coil.

2. Device for separating-out inadequately wound coils from coils conveyed individually and serially by at least one of an horizontal and inclined conveyor in direction of the longitudinal axis of the coils comprising means defining at least one coil support surface for the coils disposed at a section of the conveyor, said support surface being formed with at least one sorting opening widening in conveyance direction of the conveyor, at least part of said coil support surface in vicinity of said sorting opening being movable in at least one of the directions corresponding to said conveyance direction and a direction transverse thereto.

3. Device according to claim 2 wherein the at least part of said coil support surface is on a rotary cylinder.

4. Device according to claim 3 wherein said rotary cylinder is formed with a multifaceted surface and said rotary cylinder is rotatable in a direction tending to oppose passage of the inadequately wound coils through said sorting opening thereby preventing jamming of the coils.

* * * * *